United States Patent [19]

Igrashi et al.

[11] 4,171,558

[45] Oct. 23, 1979

[54] CUTTING OIL COMPOSITION FOR PROCESSING CEMENTED CARBIDE SKIVING HOB

[75] Inventors: Hideo Igrashi; Toshimitsu Hirose, both of Ichihara; Ryuichi Kuboki, Ichikawa; Masato Ainoura, Kita Shigeyasu, all of Japan

[73] Assignee: Idemitsu Kosan Co., Ltd., Tokyo, Japan

[21] Appl. No.: 894,277

[22] Filed: Apr. 7, 1978

Related U.S. Application Data

[63] Continuation of Ser. No. 811,924, Jun. 30, 1977, abandoned.

[30] Foreign Application Priority Data

Sep. 20, 1976 [JP] Japan ..... 51-111739

[51] Int. Cl.[2] ..... B21D 53/28; B21H 5/00; C10M 1/48; C10M 1/40

[52] U.S. Cl. ..... 29/159.2; 51/287; 72/42; 252/32.7 E; 252/33; 252/39; 252/42.7; 252/49.8

[58] Field of Search ..... 252/32.7 E, 32.5, 39, 252/33, 49.8, 42.7; 72/42; 29/159.2

[56] References Cited

U.S. PATENT DOCUMENTS

| | | | |
|---|---|---|---|
| 2,991,244 | 7/1961 | Pattenden et al. | 252/32.7 E |
| 3,400,140 | 9/1968 | Rowan et al. | 252/32.7 E |
| 3,652,410 | 3/1972 | Hollingshurt et al. | 252/32.7 E |
| 3,899,432 | 8/1975 | Rothert et al. | 252/32.7 E |
| 3,909,425 | 9/1975 | Crawford et al. | 252/32.7 E |
| 3,984,599 | 10/1976 | Norton | 252/32.7 E |

*Primary Examiner*—Delbert E. Gantz
*Assistant Examiner*—Irving Vaughn
*Attorney, Agent, or Firm*—Sughrue, Rothwell, Mion, Zinn and Macpeak

[57] ABSTRACT

A cutting oil composition for processing a cemented carbide skiving hob, which comprises (a) a base oil and (b) an effective amount to prevent wear of at least one additive blended therein selected from the group consisting of a metal-containing dithiophosphoric acid compound, a sulfonate, a phenate, a carboxylate and a phosphonate of an alkaline earth metal, and an alkyl- or arylphosphoric acid ester, the cutting oil composition having a viscosity at 100° F. of from about 3 to about 25 centistokes. The use of the cutting oil composition can obviate the compression collapse of the edge of a tool and give finished gears of good quality.

13 Claims, 1 Drawing Figure

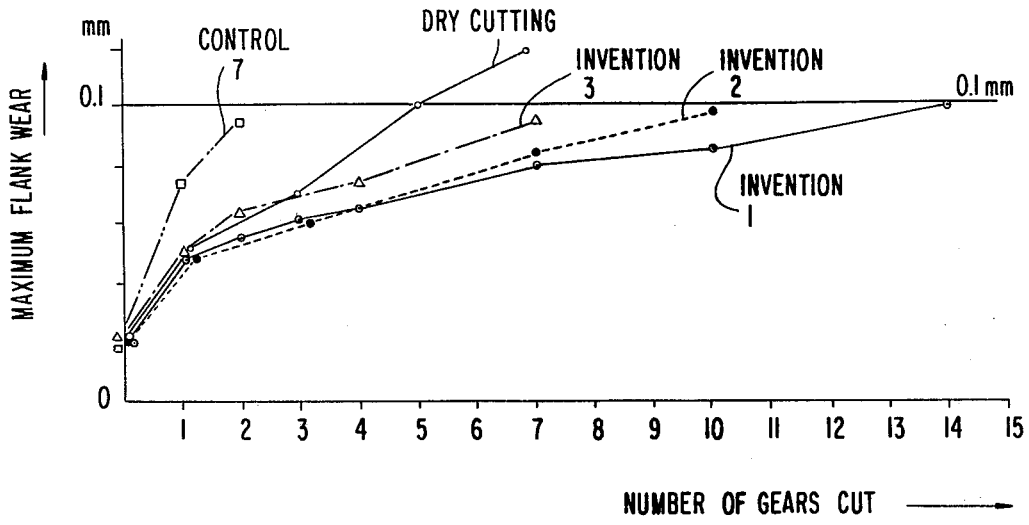
mm
CONTROL
7
DRY CUTTING
INVENTION
3
INVENTION
2
0.1 mm
0.1
MAXIMUM FLANK WEAR
INVENTION
1
0
1
2
3
4
5
6
7
8
9
10
11
12
13
14
15
NUMBER OF GEARS CUT

CUTTING OIL COMPOSITION FOR PROCESSING CEMENTED CARBIDE SKIVING HOB

This is a continuation, of application Ser. No. 811,924, filed June 30, 1977, now abandoned.

BACKGROUND OF THE INVENTION

1. Field of the Invention

The present invention relates to a cutting oil composition for processing a cemented carbide skiving hob. More particularly, this invention relates to a cutting oil composition for cemented carbide skiving hob which contains at least one specific additive and has a specific viscosity.

2. Description of the Prior Art

Cemented carbide skiving hob cutting is a relatively new processing technique as a finishing process for gears. Conventional techniques in the processing of gears having a relatively high module for use in construction machinery or shipbuilding have required the five steps of (1) rough processing, (2) finishing processing, (3) quenching, (4) shaving, and (5) honing. According to the novel technique of the present invention, the processing of gears can be accomplished using the four steps of (1) rough processing, (2) quenching, (3) skiving, and (4) honing. Furthermore, since the novel technique provides gears of high precision within a shorter period of time than that required using conventional techniques, it has been rapidly employed for the past several years in many countries.

A skiving hob results from the attachment of tips to an ordinary hob so as to adjust the rake angle of the hob to −30°. Therefore, cutting is made at an angle of −30°, and the surface of a gear of high hardness can also be finished well. Moreover, it is considered that wear of the cutting edge is slight. The details of this processing manner are described in articles appearing in Gears (the 8th Symposium of the Japan Society of Mechanical Engineers, Sendai, Japan, Aug., 1975, Article No. 750-9, pp 115–122) and Japanese Patent Publication No. 15800/75.

It is common knowledge that in cutting processing using cemented carbide tools, cutting oils are not used because the cemented carbide tools have poor resistance to heating-cooling thermal shock, and cooling readily causes cracks or breakage of the cutting edge. Thus, no cutting oil is used at all in cemented carbide skiving hob processing.

On the other hand, where this cemented carbide skiving hob processing (for brevity, such processing is hereinafter merely referred to as "SK processing") is performed without using cutting oils, disadvantages occur in that the precision of the finished gear profile becomes poor due to an elevation of the temperature of the workpieces, etc., and the life of the tool is extremely short. For this reason, use of suitable oils for the purpose of increasing the processing precision has been heretofore been desired.

According to present research, it was found that when ordinary gear cutting oils are used in SK processing, compression collapse (a kind of chipping) occurs partly on the cutting edge of the tool to thereby shorten the life of the tool, and, as a result, processing precision decreases.

As a result of extensive investigations to develop cutting oils suitable for such a kind of processing, it was found that by employing a base oil having a lower viscosity than that of known gear cutting oils and blending a certain additive thereto, the life of cutting tools can be prolonged and the precision of gears can be increased, and the present invention can be accomplished.

SUMMARY OF THE INVENTION

Accordingly, an object of the present invention is to provide a cutting oil composition which prevents compression collapse of tool edges in SK processing and increases the precision of the gears processed.

The above object and other objects of the invention are achieved by employing a cutting oil composition for a cemented carbide skiving hob comprising (a) a base oil and (b) an effective amount to prevent wear, i.e., provide wear resistance, of at least one additive selected from the group consisting of a metal-containing dithiophosphoric acid compound, a sulfonate, a phenate, a carboxylate and a phosphonate of an alkaline earth metal, and an alkyl- or arylphosphoric acid ester, with the composition having a viscosity at 100° F. of from about 3 to about 25 centistokes.

BRIEF EXPLANATION OF THE DRAWING

The FIGURE is a graph showing the relationship between the maximum wear width of the flank in SK processing and the number of gear cuts.

DETAILED DESCRIPTION OF THE INVENTION

The cutting oil composition according to the present invention must have a viscosity at 100° F. of from about 3 to about 25 centistokes as measured according to ASTM D-445. If a cutting oil composition having a viscosity of higher than about 25 centistokes is used, compression collapse of the edge of a tool becomes remarkable. On the other hand, if a cutting oil composition having a viscosity of lower than 3 centistokes is used, heavy wear of the relief surface of the tool edge occurs and, as a result, such an oil cannot be used. It is, therefore, essential for the cutting oil composition of the present invention to have a viscosity at 100° F. of from about 3 to about 25 centistokes. Compositions having a viscosity outside the above recited range do not provide excellent cutting oil compositions for SK processing regardless of the types of additives used.

The base oil for the cutting oil composition according to the present invention may be of any kind and any degree of refining. Essentially it is only necessary for the base oil to have a viscosity of about 3 to about 25 cst (at 100° F.) (ASTM D-445) so that the viscosity of the final product after adding the additives is about 3 to about 25 cst (100° F.) and any type of base oil meeting these characteristics can be used. Examples of suitable base oils which can be used include 60 spindle oil, mineral oil, 150 neutral oil, 500 neutral oil or blends thereof.

Examples of additives which can be used in the cutting oil composition of the present invention include a metal-containing dithiophosphoric acid compound, a sulfonate, a phenate, a carboxylate or a phosphonate of an alkaline earth metal, an alkyl- or arylphosphoric acid ester, or the like.

Representative examples of metal-containing dithiophosphoric acid esters which can be used include zinc dithiophosphate, oxymolybdenum sulfide organophosphorodithioate (e.g., as disclosed in Japanese Patent Publication No. 27366/69), an organotungsten compound (e.g., as disclosed in U.S. Pat. No. 3,234,129), or the like.

Suitable zinc dithiophosphates are those represented by the general formula

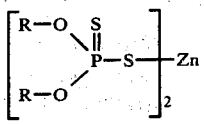

wherein R is a straight-chain or branched-chain, saturated or unsaturated alkyl group having 1 to 18 carbon atoms, a phenyl or alkylphenyl group having up to 12 carbon atoms in the alkyl moiety, a cyclohexyl group, etc.

Specific examples of zinc dithiophosphates which can be used include zinc di-n-propyl dithiophosphate, zinc di-n-butyl dithiophosphate, zinc sec-butyl dithiophosphate, zinc n-amyl dithiophosphate, zinc iso-amyl dithiophosphate, zinc n-hexyl dithiophosphate, zinc n-octyl dithiophosphate, zinc sec-octyl dithiophosphate, zinc 2-ethylhexyl dithiophosphate, zinc n-nonyl dithiophosphate, zinc iso-nonyl dithiophosphate, zinc di-tridecyl dithiophosphate, zinc di-hexadecyl dithiophosphate, zinc-octyllauryl dithiophosphate, zinc di-cyclohexyl dithiophosphate, zinc di-phenyl dithiophosphate, zinc di-trimethylphenyl dithiophosphate, zinc di-nonylphenyl dithiophosphate, zinc di-octylphenyl dithiophosphate, zinc di-dodecylphenyl dithiophosphate, zinc-octylphenyl dithiophosphate and the like.

Representative examples of alkaline earth metals which can be used for the sulfonates, phenates, carboxylates and phosphonates of alkaline earth metals include calcium, magnesium, barium or the like, and representative examples of sulfonates, phenates, carboxylates or phosphonates of alkaline earth metals which can be used include calcium sulfonate, magnesium sulfonate, barium sulfonate, calcium phenate, barium phenate, barium naphthenate, calcium salicylate, barium phosphonate or the like.

Representative examples of alkyl- or aryl-phosphoric acid esters include tributyl phosphate, trioctyl phosphate, triphenyl phosphate, tricresyl phosphate, trixylenyl phosphate, nonylphenyl phosphate or the like.

The above additives can be used individually or as mixtures thereof.

The amount of the additive used which is effective is generally not more than about 10% by weight based on the weight of finished oil. If an amount of more than about 10% by weight is added a chemical reaction is promoted due to the high temperature of the edge portion of the tool, which results in increasing the degree of wear which is generally called "chemical corrosive wear." Hence, additives which are rated 1 (grade) in the copper plate corrosion test (100° C.×1 hr) according to JIS K-2513 are particularly preferred.

The present invention is illustrated in greater detail by reference to the following Example. However, the present invention is not to be construed as being limited to this Example only. Unless otherwise indicated, all parts, percentages or the like are by weight.

EXAMPLE

SK processing was conducted using a hob ("Kashifuji KR-1000," a product of Kashifuji Iron Works, Ltd.), and the compression collapse (chipping) of the tool edge, the condition of the finished surface and the wear of the flank surface of the tool edge were evaluated.

The experimental conditions such as cutting conditions, hob specifications, the workpiece (gear) and the like are shown in (1) and (2) of Table 1 below.

Table 1

| Experimental Conditions | (1) | (2) |
|---|---|---|
| Cutting Conditions: | | |
| Cutting Speed (m/min.) | 50 | 50 |
| Feed Rate (mm/rev.) | 2.0 | 2.0 |
| Amount of Cut (mm/edge) | 0.1 | 0.1 |
| Cutting Direction | Conventional | Conventional |
| Number of Gears Cut | 15 | 6 |
| Method of Cutting | One piece cutting | One piece cutting |
| Hob Specification: | | |
| Material (carbide) | P20 | P20 |
| Module | 8 | 8 |
| Pressure Angle | 20° | 20° |
| Helix Angle | 4°35' | 4°35' |
| Direction of Torque | left | left |
| Number of Threads | 1 | 1 |
| Number of Grooves | 9 | 9 |
| Rake Angle | −30° | −30° |
| Outside Diameter of Hob | 118.5 | 118.5 |
| Edge Reduction (mm) | 0.02 | 0.02 |
| Workpiece (gear): | | |
| Material | S45C | SNCM23H |
| Hardness | Hs 75 | Hs 90 (carburization hardening) |
| Type | Spur gear | Spur gear |
| Number of Teeth | 17 | 17 |
| Tooth Width (mm) | 50 | 94 |
| Outside Diameter (mm) | 150 | 150 |

Item (1) refers to an evaluation in which the workpiece had a hardness (Hs) of 75; and item (2) refers to an evaluation in which the workpiece had a hardness (Hs) of 90. The cutting oil compositions used in the above evaluations are shown in Table 2 below.

Table 2

| Run No. | Base Oil Invention: | Viscosity of Base Oil (cst. at 100° F.) | Additive | Amount (wt.%) | Viscosity of Product (cst. at 100° F.) | Copper Corrosion Test (JIS K-2513) (100° C. × 1 hour) |
|---|---|---|---|---|---|---|
| 1 | 60 Spindle Oil | 8.86 | Organomolybdenum Compound* | 1.0 | 9.141 | 1 |
| | | | Zn-DTP | 2.0 | | |
| 2 | " | " | Ca-sulfonate | 10 | 9.533 | 1 |
| 3 | Mineral Oil (brandname, a product of Idemitsu Kosan) | 3.92 | Organomolybdenum Compound* | 1.0 | 4.188 | 1 |
| | | | Zn-DTP | 2.0 | | |
| 4 | 60 Spindle Oil (65%) + 500 Neutral Oil(35%) | 17.5 | " | 1.0 | 20.17 | 1 |
| | | | " | 2.0 | | |
| | Control: | | | | | |
| 5 | 60 Spindle Oil (50%) | | " | 1.0 | | |

Table 2-continued

| Run No. | Base Oil Invention: | Viscosity of Base Oil (cst. at 100° F.) | Additive | Amount (wt.%) | Viscosity of Product (cst. at 100° F.) | Copper Corrosion Test (JIS K-2513) (100° C. × 1 hour) |
|---|---|---|---|---|---|---|
| | + | 24.0 | | | 27.89 | 1 |
| | 500 Neutral Oil(50%) | | " | 2.0 | | |
| 6 | 60 Spindle Oil | 8.86 | — | | 8.86 | 1 |
| 7 | Cut ST-25 (brand-name, a product of Idemitsu Kosan) | " | Active sulfur and a chlorine-type extreme-pressure additive | | 10.1 | 4 |

*The Compound described in Japanese Patent Publication No. 27366/69.
Zn-DTP = Zinc dithiophosphate In Table 2 above, Nos. 1 to 4 are compositions according to the present invention, and Nos. 5 to 7 are comparison compositions. No. 5 contains an additive within the scope of the present invention, but the viscosity of the composition is outside the range specified for the present invention. No. 6 is a composition having a viscosity within the range specified in the invention, but no additive was present. No. 7 is a commercially available cutting oil having a viscosity within the range specified in the present invention but containing an additive outside the scope of the present invention.

(a) Compression Collapse of Tool Edge and Finished Surface

Compression Collapse:

Evaluated using a metal microscope having a degree of magnification of 30

Finished Surface:

Observed visually

Table 3

| Run No. | Condition (1) Compression Collapse | Condition (1) Finished Surface | Condition (2) Compression Collapse | Condition (2) Finished Surface |
|---|---|---|---|---|
| Invention: | | | | |
| 1 | 0 | A | 0 | A |
| 2 | 0 | A | 0 | A |
| 3 | 0 | A | 0 | A |
| 4 | 0 | A | 0 | A |
| Control: | | | | |
| 5 | x | D | x | D |
| 6 | x | C | x | C |
| 7 | 0 | D | x | D |
| Dry Cutting | 0 | B | 0 | B |

The compression collapse results are indicated using the following rating.

O: No collapse was observed.

X: Collapse occurred.

The finished surface results are indicated using the following rating.

A: Good

B: Fairly good

C: Slightly poor

D: poor (b) Wear of Flank Surface of Tool Edge

The progression of the maximum flank wear width under the experimental conditions (1) is shown in the FIGURE in which the ordinate represents the wear width and the abscissa represents the number of gears cut. This graph shows that cutting oils which give a curve having a lower slope and show the wear width more toward the right side of the graph are better in quality with lesser wear of the cutting edge.

The results shown in the FIGURE and the results obtained under the experimental conditions (2) are summarized in Table 4 below. Table 4 shows the number of gears cut until a maximum flank surface wear of the tool edge to 0.1 mm is reached.

Table 4

| Run No. | Condition (1) | Condition (2) |
|---|---|---|
| Invention: | | |
| 1 | 15 | 10 |
| 2 | 11 | 8 |
| 3 | 8 | 6 |
| 4 | 17 | 13 |
| Control: | | |
| 5 | 4 | 1 |
| 6 | 1 | 1 |
| 7 | 3 | 1 |
| Dry Cutting | 5 | 5 |

Note: The number of gears cut in an extrapolated value.

From the results shown in Tables 3 and 4, it can be seen that when the cutting oil composition according to the present invention is used in SK processing, compression collapse of the tool edge over long periods of time does not occur even in the case where the work piece is mild steel or a hard steel, and the finished surface is good, and further that the life of the tool can be prolonged by a factor of up to at least 3 times, whereby a remarkable improvement in SK processing technique can be achieved.

While the invention has been described in detail and with reference to specific embodiments thereof, it will be apparent to one skilled in the art that various changes and modifications can be made therein without departing from the spirit and scope thereof.

What is claimed is:

1. In skiving processing for producing a finished gear including the steps of (1) rough processing, (2) quenching, (3) skiving and (4) honing a cemented carbide skiving hob workpiece to produce a finished gear, the improvement which comprises passing a cutting oil composition comprising (a) a base oil and (b) an effective amount to prevent wear of at least one additive selected from the group consisting of a metal-containing dithiophosphoric acid compound, an alkaline earth metal sulphonate, an alkaline earth metal phenate, an alkaline earth metal carboxylate, an alkaline earth metal phosphonate, an alkyl phosphoric acid ester and an aryl phosphoric acid ester; said composition having a viscosity at 100° F. of from 3 to about 25 centistokes; over the workpiece during the skiving as a cutting oil.

2. The process of claim 1, wherein the amount of said additive is 10% by weight or less based on the weight of finished oil.

3. The process of claim 1, wherein said metal-containing dithiophosphoric acid compound is zinc dithiophosphate, oxymolybdenum sulfide organophosphorodithioate, an organotungsten compound or a mixture thereof.

4. The process of claim 1, wherein said alkaline earth metal sulfonate, alkaline earth metal phenate, alkaline earth metal carboxylate or alkaline earth metal phosphonate is calcium sulfonate, barium sulfonate, magnesium sulfonate, calcium phenate, barium phenate, barium naphthenate, calcium salicylate, barium phosphonate or a mixture thereof.

5. The process of claim 1, wherein said alkyl phosphoric acid ester or aryl phosphoric acid ester is tributyl phosphate, trioctyl phosphate, triphenyl phosphate, tricresyl phosphate, trixylyl phosphate, nonylphenyl phosphate or a mixture thereof.

6. The process of claim 1, wherein said metal-containing dithiophosphoric acid compound is a metal-containing dithiophosphoric acid ester.

7. The process of claim 6 wherein said metals are zinc, molybdenum or tungsten.

8. The process of claim 7, wherein said metal-containing dithiophosphoric acid esters are selected from the group consisting of zinc dithiophosphate and oxymolybdenum sulfide organophosphorodithioate.

9. The process of claim 1, wherein said metal-containing dithiophosphoric acid compound is a zinc dithiophosphate represented by the general formula

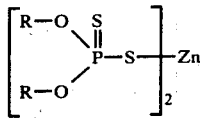

wherein R is a straight chain or branched chain saturated or unsaturated alkyl group having 1 to 18 carbon atoms, a phenyl or alkylphenyl group having up to 12 carbon atoms in the alkyl moiety.

10. The process of claim 9 wherein said zinc dithiophosphate is selected from the group consisting of zinc di-n-propyl dithiophosphate, zinc di-n-butyl dithiophosphate, zinc sec-butyl dithiophosphate, zinc n-amyl dithiophosphate, zinc iso-amyl dithiophosphate, zinc n-hexyl dithiophosphate, zinc n-octyl dithiophosphate, zinc sec-octyl dithiophosphate, zinc 2-ethylhexyl dithiophosphate, zinc n-nonyl dithiophosphate, zinc iso-nonyl dithiophosphate, zinc di-tridecyl dithiophosphate, zinc di-hexadecyl dithiophosphate, zinc-octyllauryl dithiophosphate, zinc di-cyclohexyl dithiophosphate, zinc di-phenyl dithiophosphate, zinc di-trimethylphenyl dithiophosphate, zinc di-nonylphenyl dithiophosphate, zinc di-octylphenyl dithiophosphate, zinc di-dodecylphenyl dithiophosphate, and zinc-octylphenyl dithiophosphate.

11. The process of claim 1, wherein said alkaline earth metals are selected from the group consisting of calcium, magnesium and barium.

12. The process of claim 1, wherein said alkyl phosphoric acid ester is selected from the group consisting of tributyl phosphate and trioctyl phosphate.

13. The process of claim 1, wherein said aryl phosphate ester is selected from the group consisting of triphenyl phosphate, tricresyl phosphate, trixylenyl phosphate and nonylphenyl phosphate.

* * * * *